US007735796B2

(12) United States Patent
White et al.

(10) Patent No.: US 7,735,796 B2
(45) Date of Patent: Jun. 15, 2010

(54) PROTECTIVE PADDING SYSTEM

(75) Inventors: Paul White, Lake Oswego, OR (US); Dennis Palatov, Portland, OR (US)

(73) Assignee: Compview Medical, LLC, Beaverton, OR (US)

( * ) Notice: Subject to any disclaimer, the term of this patent is extended or adjusted under 35 U.S.C. 154(b) by 560 days.

(21) Appl. No.: 11/687,607

(22) Filed: Mar. 16, 2007

(65) Prior Publication Data

US 2007/0221301 A1 Sep. 27, 2007

Related U.S. Application Data

(60) Provisional application No. 60/785,146, filed on Mar. 22, 2006.

(51) Int. Cl.
*A47B 95/00* (2006.01)

(52) U.S. Cl. ..... 248/345.1

(58) Field of Classification Search ..... 248/345.1; 52/716.4, 718.01, 718.04, 718.05, 718.06, 52/718.02, 718.03
See application file for complete search history.

(56) References Cited

U.S. PATENT DOCUMENTS 1,936,113 A * 11/1933 Jelliffe ..... 248/188.8
3,338,542 A * 8/1967 Meinhard ..... 248/345.1
3,604,670 A * 9/1971 Reeves ..... 248/250
3,916,967 A * 11/1975 Carlisle et al. ..... 248/345.1
3,991,537 A * 11/1976 Brown ..... 52/718.05
4,370,373 A * 1/1983 Janicz ..... 428/151
4,548,373 A 10/1985 Komura
5,688,569 A * 11/1997 Gilmore et al. ..... 428/31
5,748,366 A 5/1998 Yasunaga et al.

(Continued)

FOREIGN PATENT DOCUMENTS

DE 9218373 12/1992

(Continued)

OTHER PUBLICATIONS

Esco Medicon Price List from the Mar. 2005 Catalog, http://www.escoindustries.com.au/html/pg93-99.html, downloaded Mar. 26, 2005. pp. 93-99.

(Continued)

*Primary Examiner*—Korie Chan
(74) *Attorney, Agent, or Firm*—Ater Wynne LLP

(57) ABSTRACT

A simple, convenient, contaminant-resistant padding system for adding protective padding to a wide variety of hospital operating room and non-hospital related equipment is disclosed. The padding system includes an anchor having a first surface configured to be affixed to a mounting surface of an object to be protected and a second surface. The anchor also includes a protruding element formed on the second surface. The protruding element extends outward from the second surface. The system also includes a pad having a deformable recess configured to form-fit over the protruding element to hold the pad in place adjacent the mounting surface of the object to be protected. In various embodiments, the protruding element consists of one of the following shapes: hook-shaped, round, ball, oval, square, or rectangular. The deformable recess in the pad has a complementary shape. In various other embodiments, the pads can be shaped to fit over and protect one or multiple sides of an object to be protected.

18 Claims, 5 Drawing Sheets

U.S. PATENT DOCUMENTS

| | | | | |
|---|---|---|---|---|
| 5,944,291 | A | 8/1999 | Kato et al. | |
| 6,012,821 | A | 1/2000 | Yeaney et al. | |
| 6,117,127 | A | 9/2000 | Helmreich et al. | |
| 6,202,360 | B1 | 3/2001 | Rattner et al. | |
| 6,214,436 | B1 * | 4/2001 | Catta et al. | 428/99 |
| 6,328,458 | B1 | 12/2001 | Bell et al. | |
| 6,585,731 | B1 | 7/2003 | Rattner et al. | |
| 6,639,789 | B2 | 10/2003 | Beger | |
| 6,715,673 | B2 | 4/2004 | Fulcher et al. | |
| 6,732,988 | B2 | 5/2004 | Ihalainen et al. | |
| 6,793,625 | B2 | 9/2004 | Cavallaro et al. | |
| 6,817,585 | B2 | 11/2004 | Wagner et al. | |
| 6,840,486 | B2 | 1/2005 | Kuhn | |
| 6,857,609 | B2 | 2/2005 | Stoianovici et al. | |
| 6,896,233 | B2 | 5/2005 | Kuhn | |
| 7,110,173 | B2 | 9/2006 | Haisch | |
| 2004/0188578 | A1 | 9/2004 | Turner | |
| 2004/0188583 | A1 * | 9/2004 | Marsh et al. | 248/345.1 |

FOREIGN PATENT DOCUMENTS

| | | |
|---|---|---|
| DE | 19807241 | 8/1999 |
| DE | 19807242 | 8/1999 |
| DE | 19807243 | 8/1999 |
| EP | 0876799 | 11/1998 |
| WO | WO 99/23989 | 5/1999 |
| WO | WO 02/30348 | 4/2002 |

OTHER PUBLICATIONS

Office Action dated Sep. 5, 2007 in U.S. Appl. No. 11/093,075.

* cited by examiner

PROTECTIVE PADDING SYSTEM

CROSS REFERENCE TO RELATED APPLICATIONS

This application claims priority of U.S. Provisional Patent Application No. 60/785,146, filed Mar. 22, 2006, entitled "PROTECTIVE PADDING SYSTEM," which is hereby incorporated by reference.

FIELD OF THE INVENTION

The present invention relates to a protective padding system applied to objects with sharp corners or edges such as the equipment found in a hospital operating room, and more particularly, to a padding system including an anchor which includes one or more hooked shaped elements intended to be mounted onto the surface to be protected and a pad having a deformable recess configured to form-fit over the anchor to hold the a protective pad in place adjacent the mounting surface to be protected.

BACKGROUND OF THE INVENTION

There are numerous work environments where personnel are required to move about different types of equipment, some mounted at head height, and which have sharp corners or edges that can cause injury if accidentally bumped. A particular example of such an environment is a hospital operating room. In a modern hospital, video monitors, medical, and other equipment are commonly suspended, at head-height, from either the ceiling or a medical boom over the operating table. During an operation, doctors and other hospital personnel are typically intensely focused on their task and may frequently bump their head against the edges of the suspended monitors and equipment by accident, sometimes leading to injury. Currently there is no readily available solution to protect doctors and other personal from injury. Commercial edge padding products, such as Edge Guard, are typically porous and are ill-suited to a hospital environment due to both their tendency to absorb fluids and the fact that they are typically installed directly on the mounting surface with double-sided adhesive tape, making repetitive removal and replacement difficult. Further, contaminants and other fluids can easily accumulate under such a pad, creating a health hazard.

A simple, convenient, contaminant-resistant padding system for adding protective padding to a wide variety of hospital operating room and non-hospital related equipment is therefore needed.

SUMMARY OF THE INVENTION

A simple, convenient, contaminant-resistant padding system for adding protective padding to a wide variety of hospital operating room and non-hospital related equipment is disclosed. The padding system includes an anchor having a first surface, which is designed to be affixed to a mounting surface of an object to be protected. The anchor also includes a protruding element formed on a second surface, which is opposite the first surface. The system also includes a pad having a deformable recess configured to form-fit over the protruding element to hold the pad in place adjacent the mounting surface of the object to be protected. In various embodiments, the protruding element consists of one of the following shapes: hook-shaped, round, ball, oval, square, or rectangular. The deformable recess in the pad has a complementary shape. In various other embodiments, the pads can be shaped to fit over and protect one or multiple sides of an object to be protected.

BRIEF DESCRIPTION OF THE DRAWINGS

The present invention is described herein with reference to the following drawings.

Like elements are provided like reference numbers in the figures.

DETAILED DESCRIPTION OF THE INVENTION

U.S. application Ser. Nos. 11/093,075, entitled "Articulated Boom for Supporting Video and Medical Equipment in Hospital Operating Rooms" and U.S. application Ser. No. 11/686,090 filed Mar. 14, 2007 entitled "Medical Boom with Articulated Arms and a Base with Preconfigured Removable Modular Racks Used for Storing Electronic and Utility Equipment", both incorporated herein for all purposes, and assigned to the same assignee of the present application, describes a medical boom used for suspending video and other equipment in a hospital operating room. The device described in the above-mentioned applications includes boom arms attached to a structural cabinet that is mounted to the floor or wall of the operating room. Each of the boom arms includes articulated arms used to suspend flat panel video displays and other medical equipment over the operating table. Electronic equipment, such as computers, is installed or mounted directly in the cabinet. With this arrangement, the video displays are suspended at approximately head-height and could pose a hazard if a doctor or other medical personal bumped their head against the equipment. The primary purpose of the present invention is to create a contaminant-resistant protective padding system that is easy to install on the edges of the suspended video displays and other medical equipment. However, it should be noted that the use of the present invention does not necessarily have to be limited to a hospital or medical facility environment. On the contrary, it could be used on any type of equipment or surface where a protective padding is desirable.

Figure 1:
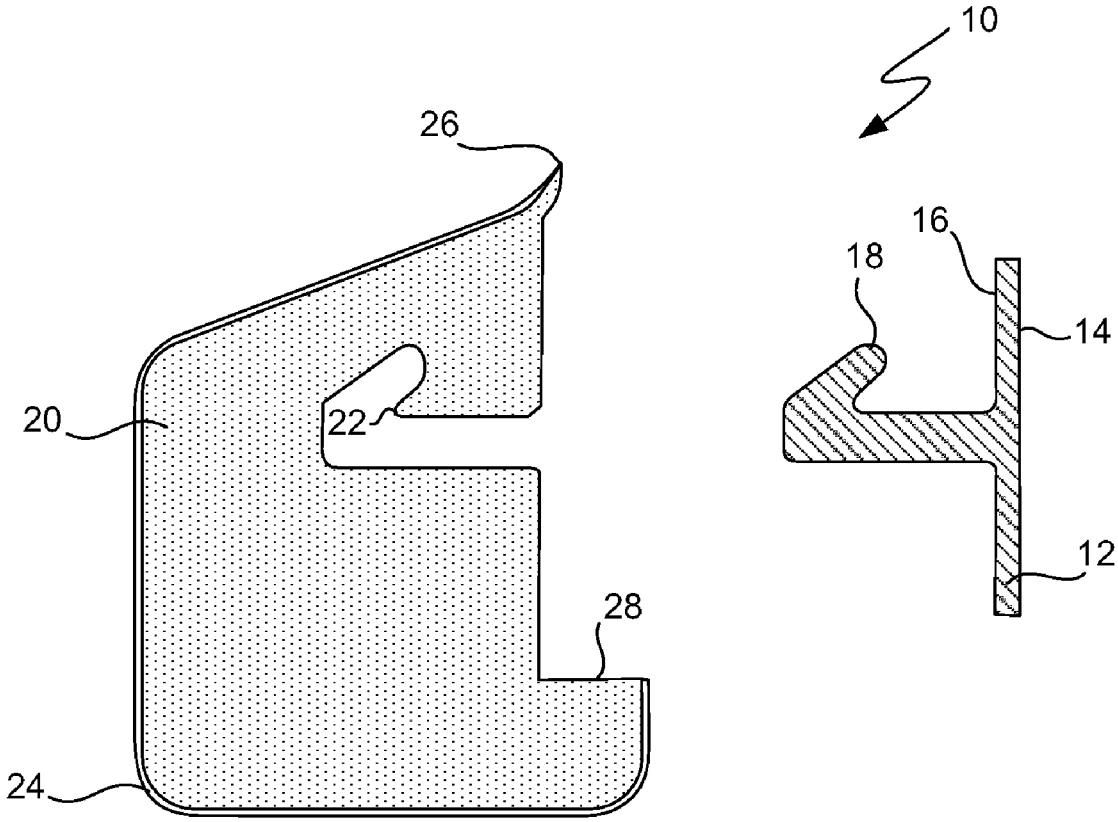
FIG. 1 shows a cross-sectional view of an anchor and a pad of the padding system of the present invention.

Referring to FIG. 1, a cross-sectional view of an anchor and a pad of the padding system of the present invention is shown. The padding system 10 includes an anchor 12 having a first surface 14 intended to be affixed to a mounting surface of an object to be protected (not shown) and a second surface 16. A protruding hooked-shaped element 18 is formed on and extends outward from the second surface 16. The system 10 also includes a pad 20 made from a resilient, deformable material. The pad includes a hooked-shaped deformable recess 22 that is designed to form-fit over the hooked-shaped element 18 of the anchor 12. The pad 20 further includes an exterior cleanable surface 24. In the embodiment shown, the pad optionally includes a deformable edge 26 and a protruding edge 28. In alternative embodiments, the pad 20 can be made without the deformable edge 26 or the protruding edge 28, or both, depending on the shape of the surface of the object to be protected.

Figure 2:
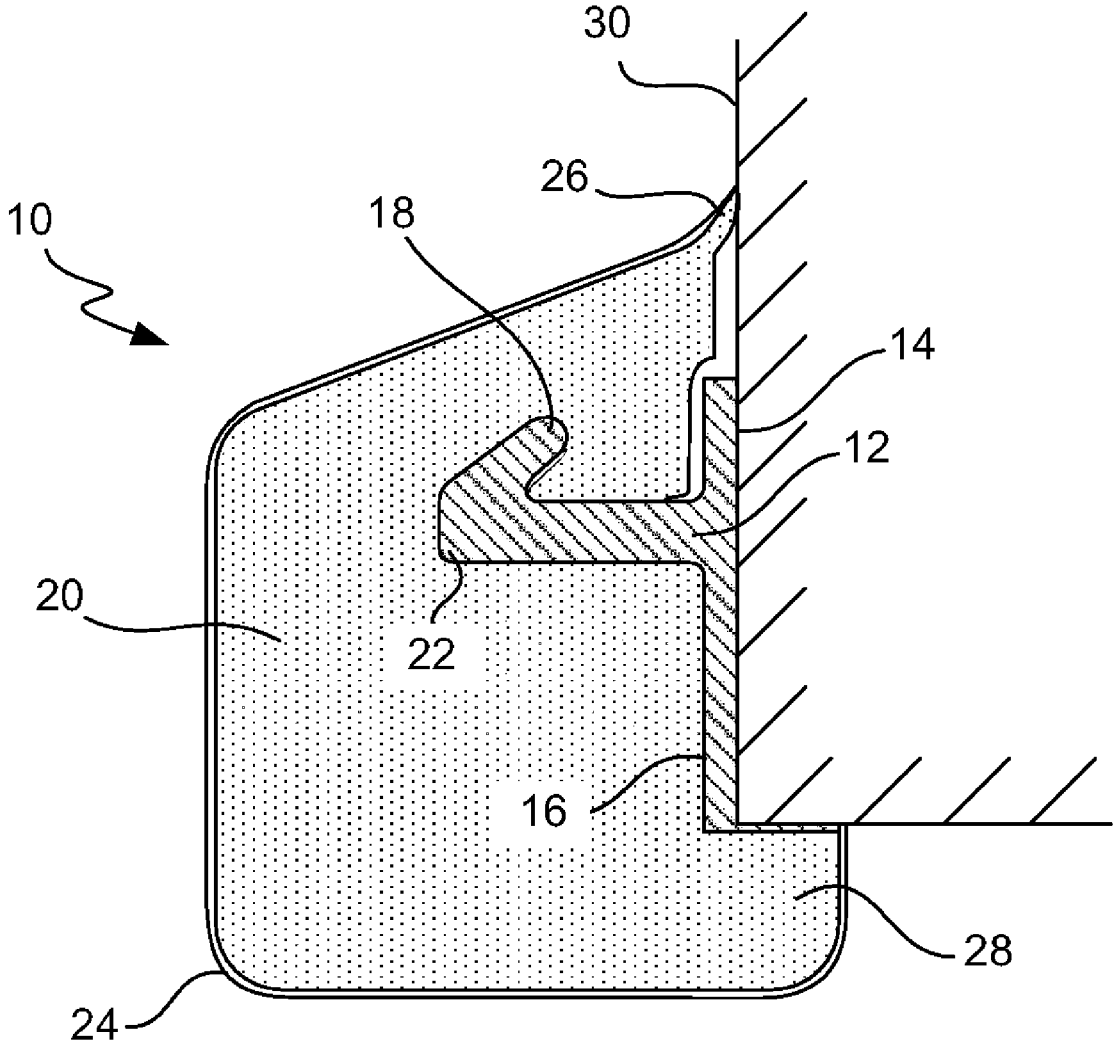
FIG. 2 is another cross-sectional view of the pad retained by the anchor and mounted onto a surface of an object to be protected according to the present invention.

Referring to FIG. 2, another cross section of the pad system 10 is shown protecting the mounting surface 30 of the object to be protected. As illustrated in the figure, the anchor 12 is affixed to the mounting surface 30. The pad 20 is mounted onto the anchor 30 by formfitting the recess region 22 over the hooked shaped element 18 of the anchor 12. Since the pad 20 is made of a deformable material, the recess region 22 resiliently fits over the hooked shaped element, holding the pad 20 in place over the surface 30. The deformable edge 26 also compresses against the surface 30, forming a seal. The protruding edge 28 extends around the edge of the surface 30, protecting the corner of the object to be protected. As noted above, the protruding edge 28 is optional. In situations where the surface 30 of the object to be protected does not include a corner edge, a pad 20 without the protrusion 28 would be used. Similarly, the deformable edge 26 is also optional and may be eliminated if a seal between the pad and the surface to be protected is not desirable.

Figure 3A:
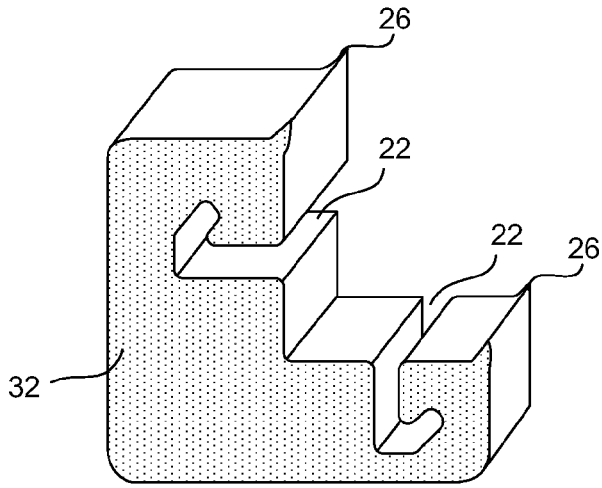
FIGS. 3A through 3C illustrate various pad shapes according to the present invention.
Figure 3B:
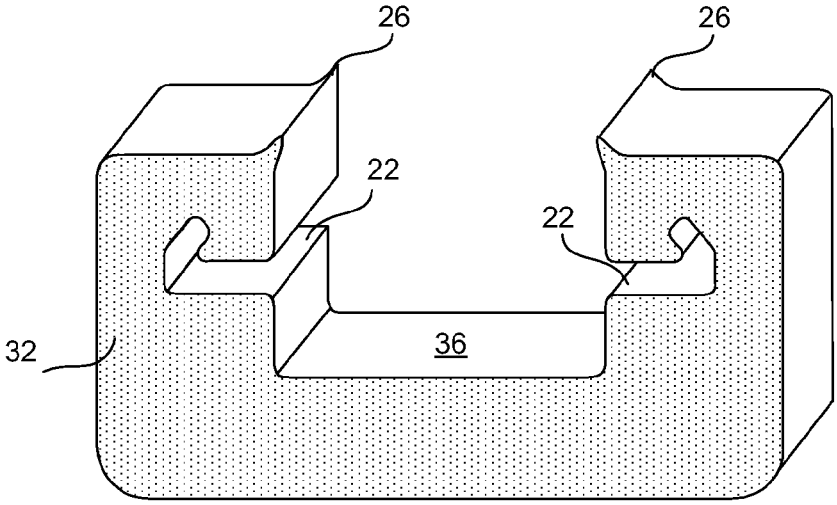
Figure 3C:
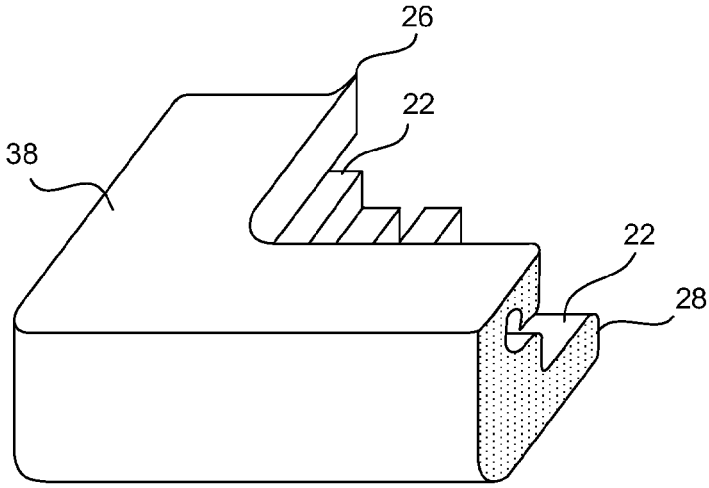

Referring to FIGS. 3A through 3C, cross section views of pads of various embodiments of the present invention are shown. In FIG. 3A, a pad 32 intended to cover the two perpendicular sides of an object to be protected is shown. The pad 32 includes two recesses 22 oriented at a right angle with respect to one another and deformable edges 26 at each end of the pad. In FIG. 3B, a pad 34 intended to protect three sides of an object is shown. With this embodiment, the pad 36 has two recess regions 22 on opposite sides of one another and a middle padded protective surface 36. In FIG. 3C, the pad 38 is designed to fit over a corner of the object to be protected. The pad 38 includes recess region 22, deformable edge 26 and protruding edge 28, all of which contour to the corner shape of the pad 38. It should be noted that the embodiments shown in FIGS. 3A-3C are merely exemplary and are intended to illustrate the principle of the present invention. In no way should the particular shape or the features of the pads 32, 34 and 38 be construed as limiting the present invention in any way.

Figure 4A:
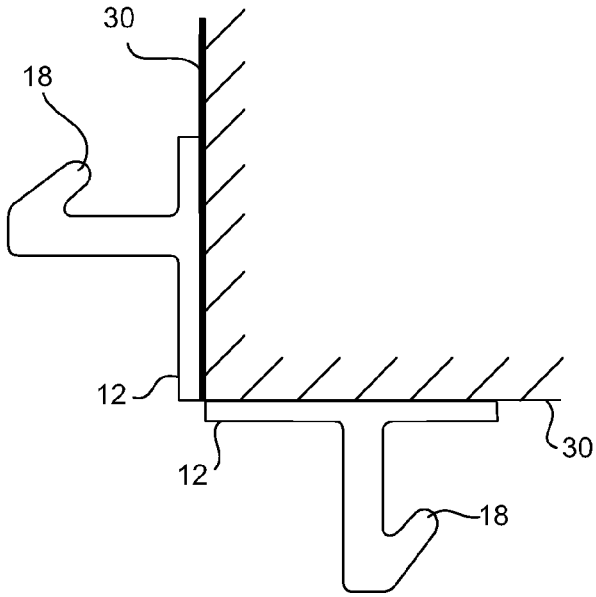
FIGS. 4A through 4C illustrates various arrangements of anchors used to secure the pads to different surfaces of the objects to be protected according to various embodiments of the present invention.
Figure 4B:
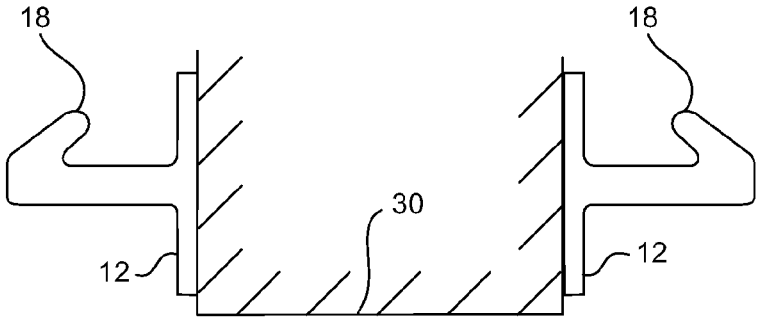
Figure 4C:
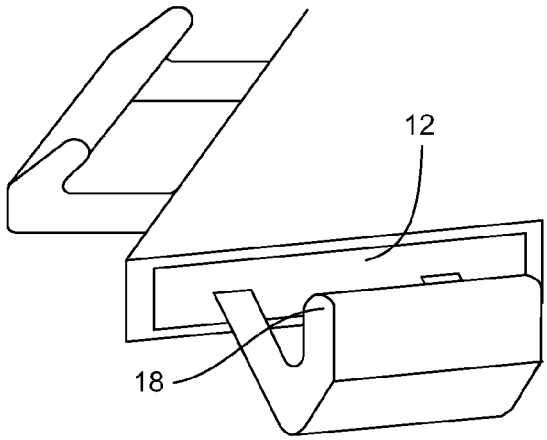

Referring to FIGS. 4A through 4C, anchor configurations to be used with the pads of FIGS. 3A through 3C are shown respectively. In FIG. 4A, two anchors 12 are mounted at right angles with respect to one another on two adjacent sides (i.e., a side and bottom surface) of the object 30 to be protected. In FIG. 4B, two anchors 12 are mounted on opposing sides of the object to be protected. In FIG. 4C, two anchors 12 are mounted on the corner sides of the object 30 to be protected.

Figure 5A:
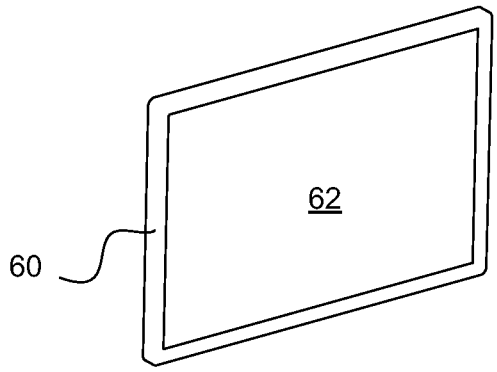
FIG. 5A is a diagram of a pad used for a video display monitor.

Referring to FIG. 5A, a pad 34 designed specifically for a video monitor display is shown. The pad 60 is rectangular in shape and is designed to fit around the perimeter of the video display monitor to be protected. The pad 60 also includes an open recess region 62 through which the display and back panel of the monitor are visible. In various embodiments, the pad 34 can be designed to protect two sides (i.e., like the pad illustrated in FIG. 3A) or three sides (i.e., like the pad of FIG. 3B) of the video display monitor.

Figure 5B:
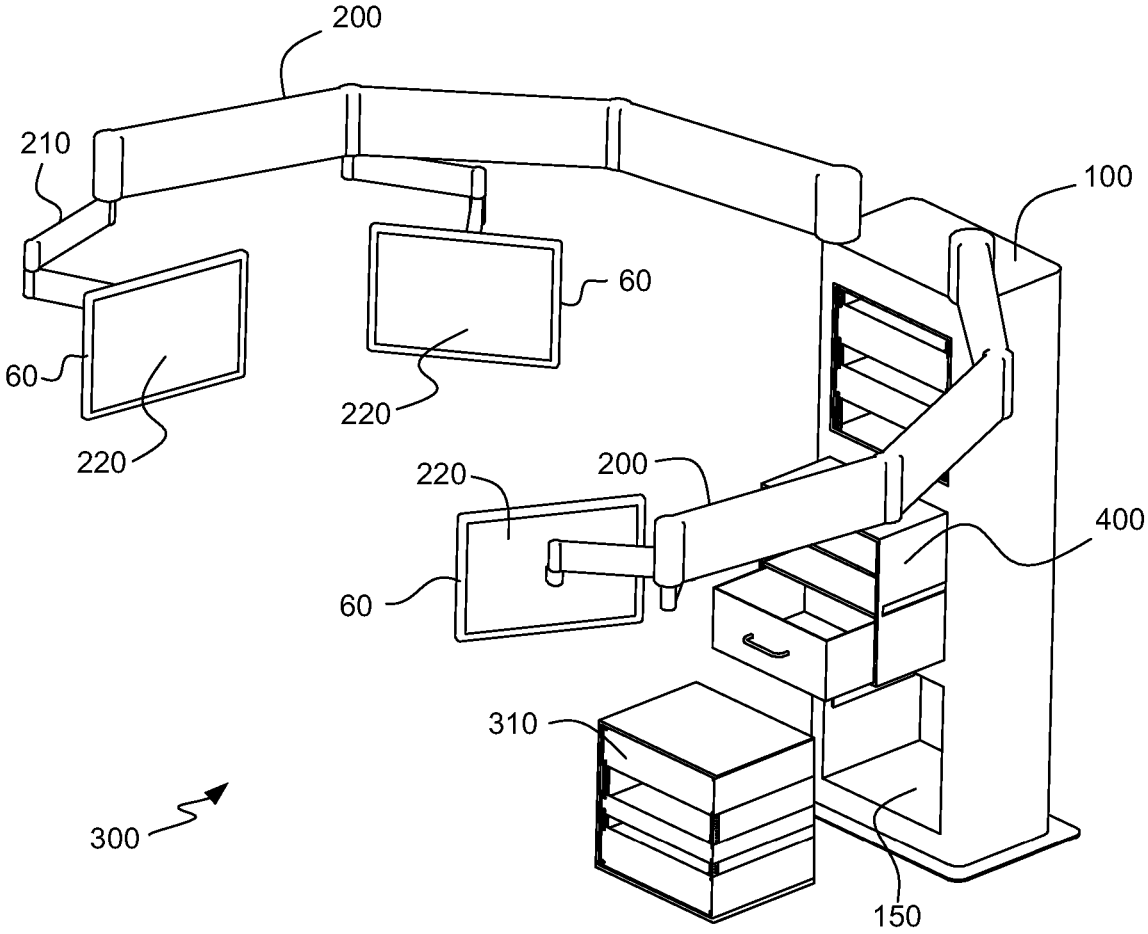
FIG. 5B is a diagram of a medical boom using the pad of the present invention on video display monitors according to one application of the pad system of the present invention.

Referring to FIG. 5B, a medical boom such as that described and illustrated in the above-identified co-pending application is shown. The medical boom 300 includes a cabinet 100 for housing electronic and medical equipment and a number of boom arms 200. Articulated arms 210 suspend a number of video display monitors 220 from the boom arms 200. Pads 60 are affixed in the manner described above around the perimeter edge of the monitors 220. Thus, if a doctor or other medical personal were to bump their head against the monitor, they would be protected from injury by the pads 34. Again, the use of the pad 34 for use in this application is merely exemplary. Pads of a wide variety of shapes could be used.

According to various embodiments, the anchor 12 and the hook-shaped element 18 are made from a unitary molded inert material. In various embodiments, a material such as polyethylene is used. In other embodiments, the anchor may include a plurality of hooked shaped elements or one or several continuous hooked-shaped elements. In yet further embodiments, the element 18 does not necessarily need to be hooked-shaped. Alternatively, the element 18 can be just about any configuration, such as ball shaped, oval shaped, square shaped, rectangular, or just about any other feasible shape. With these various embodiments, the shape of the recess region 22 on the pad would also be altered. Generally speaking, the recess region(s) 22 of the pad should complement the shape, configuration and number of the element(s) 18 on the anchor 12. In various additional embodiments, different affixing elements may be used to affix the anchor 12 to the surface 30 to be protected. These affixing elements may include adhesive, tape, double-sided adhesive tape, screws, nails, bolts or other fasteners. In yet other embodiments, the pad may be made with any soft or resilient material and may assume a variety of shapes such as rectangular, square, round, oval, straight, curved, L-shaped or any other multi-sided or curved shape. In yet other embodiments, the pads can be made into a number of "stock" shapes that can be used for a wide variety of applications. Alternatively, the pads and anchors can be custom made for a specific item to be protected. For example, the pads and the anchors can be custom made to fit around the perimeter of a 42-inch or a 50-inch flat panel display.

In the one embodiment of the present invention, the anchors 12 are molded from a highly inert plastic material such as polyethylene and are installed on the equipment being protected by a high strength double-sided adhesive tape. In other embodiments, fasteners may be advantageous such as screws or bolts. The surface of the pad is according to one embodiment is non-porous and can be readily cleaned. This non-porous surface can be readily achieved by any number of known methods, such as coatings and films applied to the pad. If the pad is made using a molding process, these coatings can be applied either to the mold surface prior to injection of pad material into the mold or to the molded pad after it is removed from the mold, as is known in the art.

In a typical installation, one or more anchors are installed on the equipment to be protected by one of above-listed affixing elements. The alignment of the anchors relative to edges of the equipment is typically preferably. Once anchors are affixed, the appropriately shaped pads are installed by placing inserting the element(s) 18 into the recess region(s) 22 of the pad. During installation, it may be necessary to stretch or compress the pads to make sure they are properly installed.

As shown in the preceding descriptions, the protective pad system of the present invention can be readily installed on a wide variety of equipment, such as video monitors and other medical equipment found in a hospital, effectively protecting personnel from injury should accidental contact with equipment occur. The described and illustrated embodiments of the present invention are intended to be exemplary and should not be construed as limiting. Other non-hospital applications and embodiments may become apparent to persons skilled in the art based on the teaching of the present invention without departing from it in scope and spirit.

We claim:

1. A padding system for padding an edge corner of an object, the edge corner formed by an intersection of a mounting surface and an adjoining side surface of the object, the adjoining side surface being substantially perpendicular to the mounting surface, the padding system comprising:

an anchor having a protruding element and a flat base, the protruding element including a latch, the base including a first surface and an opposing second surface, the protruding element extending out of the second surface of the base, the first surface of the base arranged to be affixed to the mounting surface of the object, wherein no part of the anchor bends around the edge corner and covers a portion of the side surface of the object when the first surface of the base is affixed to the mounting surface of the object; and a pad having a deformable recess configured to form-fit the protruding element of the anchor and engage the latch of the protruding element such that the pad is held in place and secured to the anchor, the pad having an engagement surface configured to engage the second surface of the base and the pad having a protruding portion extending outward from the engagement surface, such that the protruding portion of the pad extends past the base of the anchor and the pad covers at least portions of the anchor, the edge corner, the mounting surface and the side surface of the object when the first surface of the base is affixed to the mounting surface of the object and the deformable recess of the pad is form-fitted with the protruding element of the anchor.

2. The system of claim 1, wherein the pad is made of a resilient material.

3. The system of claim 1, wherein the anchor and the protruding element are made from a unitary molded inert material.

4. The system of claim 3, wherein the inert material comprises polyethylene.

5. The system of claim 1, wherein the anchor further includes a plurality of the protruding elements.

6. The system of claim 5, wherein the pad includes a plurality of the deformable recesses configured to form-fit over the plurality of protruding elements of the anchor respectively.

7. The system of claim 1, further comprising an affixing element configured to affix the anchor to the mounting surface, the affixing element being one selected from the group consisting of: an adhesive, a tape, a double-sided adhesive tape, a screw, a nail, a bolt and a fastener.

8. The system of claim 1, wherein the pad includes a cleanable surface.

9. The system of claim 1, wherein the pad has a shape that is one selected from the group consisting of: rectangular, square, round, oval, straight, curved, L-shaped, multi-sided and curved.

10. The system of claim 1, wherein the protruding portion forms a seal with the mounting surface when the pad is form-fitted over the protruding element.

11. The system of claim 1, wherein one or more of the anchors are configured to be affixed to one or more mounting surfaces on the object.

12. The system of claim 11, wherein the pad is intended to protect the one or more mounting surfaces on the object.

13. The system of claim 1, wherein the protruding element has a shape that is one selected from the group consisting of: hook-shaped, round, ball, oval, square, and rectangular.

14. A method, comprising:

affixing a first surface of a flat base of an anchor to a mounting surface of an object, the anchor having a protruding element that extends out of a second surface of the base, the second surface of the base opposing the first surface of the base, the object further including an edge corner formed by an intersection of the mounting surface and an adjoining side surface of the object that is substantially perpendicular to the mounting surface of the object; and installing a protective pad over the mounting surface by form-fitting a deformable recess in the pad over the protruding element of the anchor wherein:

no part of the anchor bends around the edge corner of the object;

no part of the anchor covers any portion of the side surface of the object;

a latch of the protruding element holds the pad in place and secures the pad to the anchor;

an engagement surface of the pad engages the second surface of the base;

a protruding portion of the pad extends outward from the engagement surface and past the base of the anchor; and the pad covers at least portions of the anchor, the edge corner, the mounting surface and the side surface of the object.

15. The method of claim 14, further comprising forming a seal between the pad and the mounting surface with a compressible edge on the pad.

16. The method of claim 14, further comprising periodically cleaning the protective pad when installed over the mounting surface to be protected.

17. The method of claim 14, further comprising periodically replacing the protective pad with a new protective pad when appropriate.

18. The padding system of claim 1, wherein:

the protruding element and the recess in the pad are hook-shaped, such that the pad resists removal from the protruding element when the protruding element of the anchor is form-fitted into the recess of the pad and the pad is pulled in a direction that is substantially perpendicular to the second surface of the base of the anchor; and the protruding element physically connects to the base of the anchor at a single, contiguous region on the second surface of the base and not at any other separate region on the second surface of the base.

* * * * *